United States Patent [19]

Herzhauser

[11] Patent Number: 5,030,150

[45] Date of Patent: Jul. 9, 1991

[54] SPLASH GUARD ASSEMBLY

[76] Inventor: Ludwig Herzhauser, P.O. Box 1510, Marathon, Fla. 33050

[21] Appl. No.: 456,566

[22] Filed: Dec. 26, 1989

[51] Int. Cl.[5] ..... B63H 23/36

[52] U.S. Cl. ..... 440/112; 277/12; 277/59

[58] Field of Search ..... 440/83, 111, 112; 277/59, 72, 60, 9, 66, 29, 70, 71; 114/183 R

[56] References Cited

U.S. PATENT DOCUMENTS

| | | | |
|---|---|---|---|
| 2,306,664 | 3/1941 | Scott-Paine | 440/112 X |
| 3,030,118 | 4/1962 | Groce | 277/59 |
| 3,946,694 | 3/1976 | Belsky | 114/183 R |
| 4,174,672 | 11/1979 | Cox | 440/112 |

*Primary Examiner*—Ed Swinehart

*Attorney, Agent, or Firm*—Malloy, Downey & Malloy

[57] ABSTRACT

An assembly for the collection and channeling of water leaking beyond a stuffing box or other seal assembly which is normally provided to isolate a rotating propeller shaft in a marine craft from the water in which the craft rides. A receiving chamber is disposed at an inner most end of the sealing assembly or stuffing box in receiving relation to leaking water passing along the shaft wherein the receiving chamber communicates with a liquid exit or collection facility for the removal of the water from the shaft before the water can enter into the interior of the craft.

14 Claims, 3 Drawing Sheets

SPLASH GUARD ASSEMBLY

BACKGROUND OF THE INVENTION

1. Field of the Invention

This invention relates to a splash guard or like device to prevent leakage into a boat of water passing beyond the sealing assembly or stuffing box normally disposed to restrict leakage along the propeller shaft during operation of the boat.

2. Description of the Prior Art

In propeller driven marine craft, an elongated propeller shaft is rotatably driven at relatively high speeds in order to adequately drive the propeller for the propulsion of the craft through water. When the marine craft is designed to be propelled by an inboard motor, the propeller shaft usually assumes a relatively extended longitudinal dimension and passes through the bottom of the boat generally in the stern area so that the propeller may be properly located rearwardly and somewhat beneath the boat. In each instance, regardless of the size of the craft, a well known problem exists with water leaking into the interior of the craft frequently to the area of the engine compartment or engine room in larger marine crafts even though such leakage is attempted to be restricted by prior art sealing assemblies or stuffing boxes. Typically, such stuffing boxes include packing or like sealing material engaging the outer surface of the shaft while it is rotating. The stuffing box or sealing assembly is designed to effectively restrict or minimize the inflow of leakage or water from the exterior of the craft into its interior during rotation of the shaft. While excess leakage can be controlled to the extent of replacing the packing material of the stuffing box and/or "tightening" certain adjustable mounting features associated with most prior art stuffing boxes, the problem of leakage still exists and presents a major problem.

Accordingly, there is a need for an assembly which would effectively eliminate such leakage while not requiring structural modification of the craft and allow utilization of conventional packing assemblies or stuffing boxes by being cooperatively structured to capture and/or divert any flow of water leaking beyond the stuffing box of the rotating shaft.

Such a preferred assembly should be reliable in terms of preventing the aforementioned leakage, easy and inexpensive to install by being structurally adaptive to the structure and location of the rotating propeller shaft.

SUMMARY OF THE INVENTION

The present invention relates to what may be termed a "splash guard" but more specifically, is directed to an assembly for the preventing of leakage of water into the interior of the marine craft. In accordance with the structure of this invention, leakage of water beyond a sealing assembly or stuffing box mounted in sealing engagement with the rotating propeller shaft into the interior of the craft is prevented. The splash guard assembly of the present invention comprises a housing having a somewhat annular configuration to the extent that the rotating propeller shaft is allowed to pass therethrough. The housing further includes, at least in part, an outer cylindrical wall disposed at least partially in outwardly spaced relation from the outer surface of the propeller shaft so as to de fine a receiving chamber therebetween. Disposition of the receiving chamber is such as to be disposed in liquid receiving relation at the inner most or trailing end of the sealing assembly or stuffing box secured in sealing engagement with the rotating propeller shaft. Such sealing assembly or stuffing box may take any of a variety of standard or conventional configurations used to prevent or at least minimize the leaking of water into the exterior of the craft, along the shaft beyond the packing material of the stuffing box. Further, the receiving chamber, has a somewhat annular configuration disposed in surrounding relation to the outer surface of the rotating shaft and includes a liquid drain or exit formed therein.

In a preferred embodiment to be described in greater detail hereinafter, the liquid drain or exit may be located generally at a low point in the surrounding receiving chamber. Collected water leaking past the stuffing box is captured within the receiving chamber and passes along the receiving chamber transversely to the length of the shaft until it reaches the drain or water exit. The water then flows through this drain to a collection facility or sump.

A sump pump as well as any type of float switch or like structure may be located in the sump or collection facility and serve to force water from the interior thereof overboard when sufficient water has been collected. Such collection facility could, of course, assume the normal sump arrangement found in most marine crafts and the sump pump will serve as the pump means for forcing the collected water from the receiving chamber of the housing outwardly from the marine craft.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Figure 1:
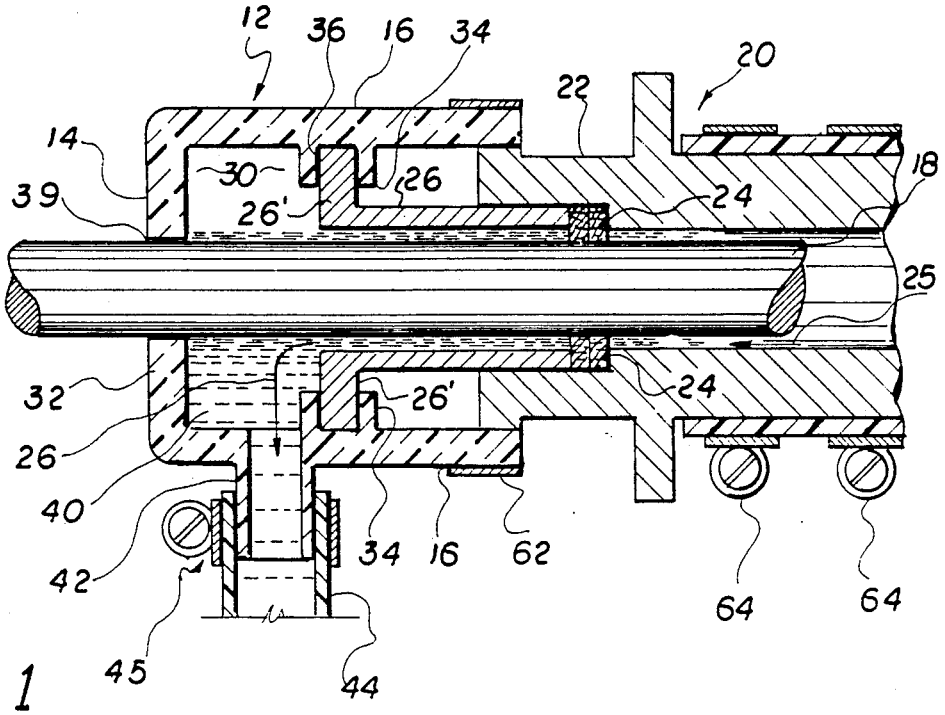
FIG. 1 is a cross-sectional view of the leak protector and splash guard assembly of the present invention.

As shown in FIGS. 1 through 6, the present invention is directed to an assembly for the protection of leaks into the interior of a boat or like marine craft generally indicated as 10. The protector assembly of the present invention can generally be referred to as a splash guard and is shown in various embodiments in FIGS. 1 through 3 and 6. In FIG. 1, the splash guard assembly is generally indicated as 12 and includes a housing 14 having an outer substantially cylindrical wall as at 16 disposed in concentric, surrounding relation to a rotatable propeller shaft 18 of the type found on marine craft and used to rotate screw type propellers at relatively high speeds. Typically, as shown in FIGS. 1 through 3 and 6, the propeller shaft has mounted thereon a packing box or like sealing assembly generally indicated as 20. Such packing box may take a variety of configuration and usually includes an outer casing and/or attachment member 22 having packing material 24 mounted on the interior thereof in actual sealing engagement with the outer surface of the rotating shaft 18. An inner casing structure and/or mounting member 26 may also be associated with the sealing assembly or packing box 20 and is shown in abutting, retaining relation to the packing material 24.

For purposes of clarity, the space between the inner surface of the inner casing or retaining member 26 and the outer surface of the propeller 18 is somewhat enlarged to demonstrate that regardless of the existence or efficiency of the packing material 24, water from the exterior of the craft 10 still has a tendency and will in fact leak along the length of the propeller 18 as indicated by directional arrows 25 and 26.

The splash guard 12 defines an inner substantially annular receiving chamber 30 disposed at what may be considered an inner end of the housing 14 between an end most wall 32 and an inwardly extending or projecting lip 34 having a receiving groove as at 36 formed therein. The inwardly directed lip 34 is specifically dimensioned to attach to an outwardly projecting flange 26' which may be considered a part of the retaining member 26 associated with the sealing assembly 20. The inner most end 32 of the housing 12 may have a seal structure as at 39 to ensure that water collected within the receiving chamber 30 does not further pass along the shaft 18 and into the interior of the craft.

The collected water as at 40 received within the receiving chamber 30 passes therefrom by means of a liquid exhaust or vent 42 communicating with the interior of the chamber at a location which due to gravity or other considerations may be located preferably below the shaft 18. The liquid exhaust or vent 42 is connected to a conduit as at 44 for directing the water from the receiving chamber 30 to a collection facility.

Figure 4:
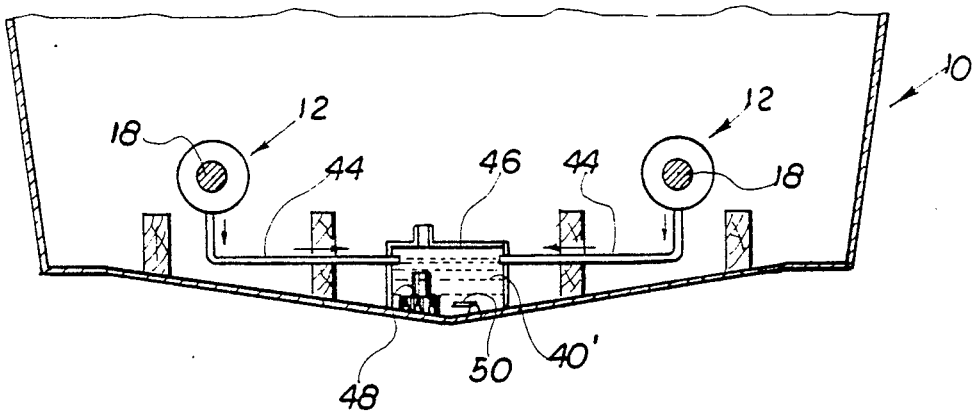
FIG. 4 is a cross-section and partial schematic representation of a collection facility associated with removing leaking water and collecting in a sump type collection tank.
Figure 5:
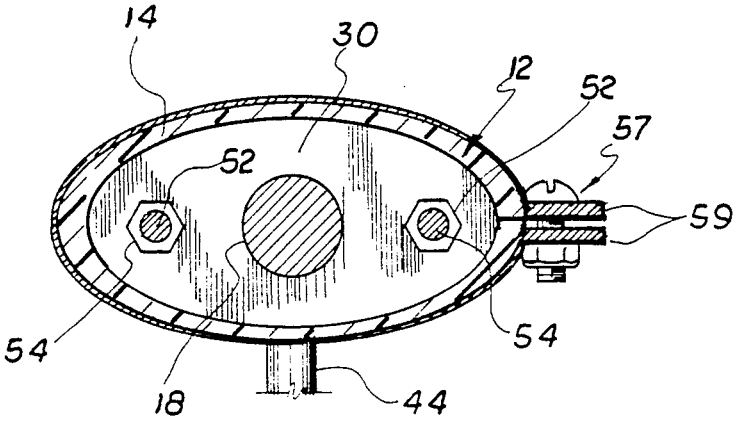
FIG. 5 is a transverse sectional view of the embodiment of the FIG. 1.

With reference to FIG. 4, such collection facility may be in the form of a sump 46 or like facility in which the water 40' is collected. A sump pump 48 may be used in combination with the collection facility 46 so as to direct water outwardly therefrom to the exterior of the craft in the usual manner. A float switch or like sensing mechanism as at 50 may be provided on the interior of the sump 46 in order to activate the sump pump when the water reaches a predetermined level. With regard to the embodiment of FIG. 4, an appropriate mounting means generally shown in FIG. 5 may be attached so as to secure the splash guard assembly 12 to the sealing assembly 20 in its operative position as explained with regard to FIG. 1. As shown in FIG. 5, such elongated bolts may be indicated as 52 and attached at one end by locking nuts 54. The housing may otherwise be clamped as shown in FIG. 5 by a connector assembly serving to attach connecting flanges 59 in the manner clearly shown in FIG. 5.

Figure 6:
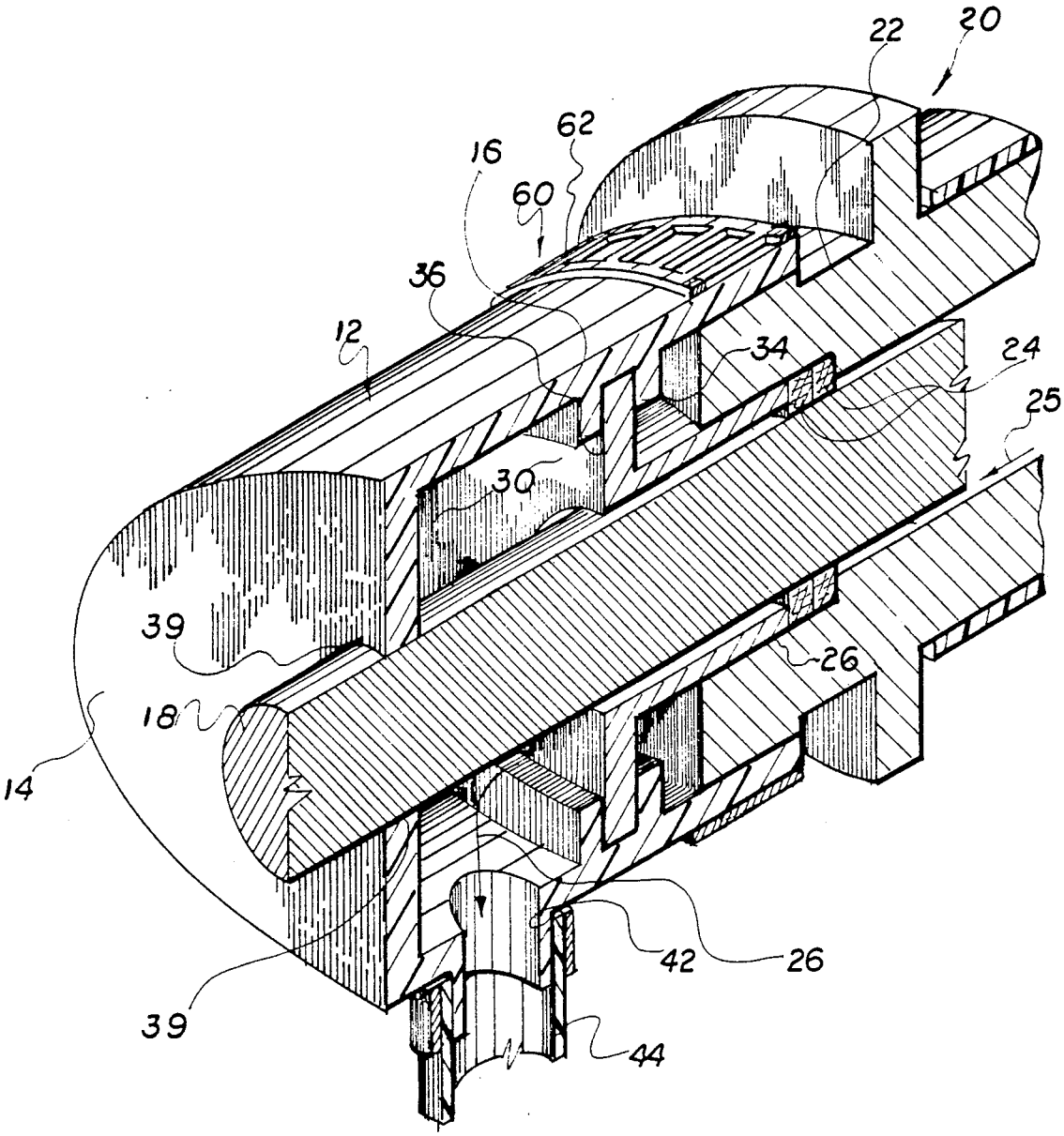
FIG. 6 is a perspective view in partial cutaway of one preferred embodiment of the present invention.

Further with reference to FIGS. 5 and 6, it can be seen that the casing 14 of the splash guard assembly 12 may have a somewhat oblong or oval configuration or alternately, may be circular as schematically represented in FIG. 4.

Figure 2:
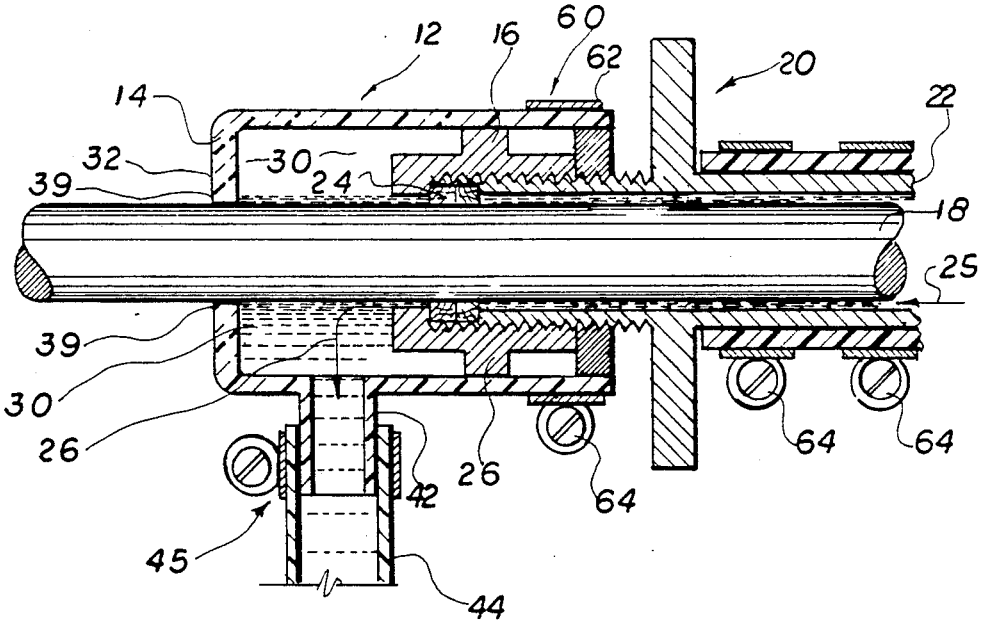
FIG. 2 is a cross-sectional view of another embodiment of the present invention.

With reference to FIG. 2, the splash guard assembly 12 has a similar configuration defined by an outer cylindrical wall 16 spaced from the outer surface of the propeller 18. Such outer spacing defines the receiving chamber 30 in which leaking water is collected as it passes along the outer surface of the propeller shaft 18 beyond the packing material 40 considered to be part of the sealing assembly 20. The water or liquid exit 42 is also connected to a conduit or like 44 directed to a similar collection or sump facility 46 (see FIG. 4) wherein such connection occurs by a band clamp or like applicable connector as at 45.

Structural differences between the embodiment of FIG. 2 and the remaining embodiments of the present invention include the outer casing as at 22 being externally threaded to threadably engage the internal threaded surface of the retainer 26 as clearly shown in FIG. 2. The packing material 24 is clamped therebetween and may be tightened so as to reduce the leakage of the water 40 into the chamber 30. However, as set forth above, leakage will still occur beyond the packing material 24.

A mounting means generally indicated as 60 serves to connect the housing 14 in surrounding relation to the shaft 18 as well as a portion of the sealing means or packing box 20. Such mounting means 60 includes a plurality of band clamps 62 tightened in its surrounding engagement with the outer surface of the housing 14 and also surrounding portions of the packing box by a conventional connector element as at 64.

Figure 3:
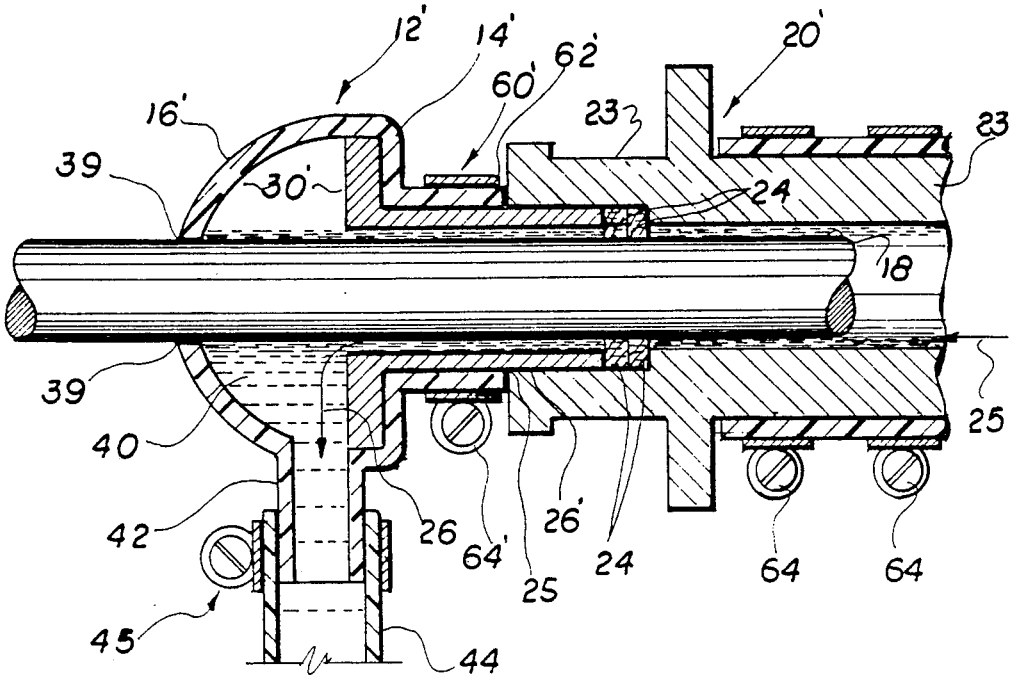
FIG. 3 is a cross-sectional view of yet another embodiment of the present invention.

With regard to the embodiment of FIG. 3, the housing 12' includes an outer cylindrical wall 16' which has a substantially curvilinear cross-sectional configuration as shown in FIG. 3. The receiving chamber 30' is still disposed at an inner most end of the housing in receiving relation to the water 30 leaking along the outer surface of the rotating propeller shaft 18. In this embodiment, the sealing means 20' includes the packing material as at 24 and an outer combination casing and retaining collar as at 23. The inner most surface or end as at 25 may be threaded or otherwise connected to the outer surface of the retaining member 26' as shown. The water still passes from the liquid or water exit 42 communicating with the receiving chamber 30 and from there passes along the length of the conduit 44 to the sump or collection facility 46. The transverse configuration of the embodiment of FIG. 3 is preferably circular but may be any other applicable configuration corresponding to the specific structure of the sealing means 20' or other structural features associated with the marine craft.

Now that the invention has been described,

What is claimed is:

1. A leak collection assembly adapted to be mounted to a shaft seal assembly on a propeller shaft used in a marine craft, said assembly comprising:

a housing structure adapted to be removably connected to the shaft seal assembly so as to be disposed in surrounding relation to the propeller shaft, a seal means on a proximal end of said housing disposed in surrounding, sealing engagement with the propeller shaft, a receiving chamber means formed within said housing and disposed between said seal means and the shaft seal assembly for receiving water leaking between the shaft seal assembly and the propeller shaft, said receiving chamber disposed in substantially surrounding relation to the propeller shaft and including a liquid exhaust formed therein in communicating relation to an exterior of the marine craft, and mounting means for removably securing said housing about the shaft seal assembly and including an attachment band disposed in confronting engagement with an outer surface of said housing concentric to the propeller shaft and the shaft seal assembly.

2. An assembly as in claim 1 wherein said housing includes an outer cylindrical wall disposed in outwardly spaced and surrounding relation to the shaft, said seal means disposed inwardly of said outer cylindrical wall in confronting engagement with said shaft.

3. An assembly as in claim 2 wherein said receiving chamber means is disposed within said outer cylindrical wall in liquid receiving relation to liquid passing along an outer surface of said shaft.

4. An assembly as in claim 3 wherein said receiving chamber comprises a substantially annular configuration disposed in surrounding relation to said shaft.

5. An assembly as in claim 4 wherein said housing and said receiving chamber comprise an oblong configuration with the rotating shaft extending along substantially the center thereof.

6. An assembly as in claim 4 wherein said housing and said receiving chamber comprise a substantially circular, cross-sectional configuration with the rotating shaft disposed to extend along substantially a central longitudinal axis thereof.

7. An assembly as in claim 1 wherein said liquid exhaust is disposed within said chamber beneath the shaft.

8. An assembly as in claim 7 wherein said liquid exhaust is disposed at a substantially low point within said chamber.

9. An assembly as in claim 2 wherein said seal assembly comprises a stuffing box extending along a length of the shaft and includes an endmost substantially annular flange disposed on a proximal end thereof and extending outwardly therefrom.

10. An assembly as in claim 9 wherein said housing includes an inwardly extending mounting lip having a substantially annular configuration and disposed in engaging, supported relation on said flange.

11. An assembly as in claim 10 wherein said receiving chamber is defined at one end thereof by said annular flange and said mounting lip.

12. An assembly as in claim 12 wherein said mounting means comprises said attachment band secured to an outer surface of said housing adjacent a leading portion thereof, said attachment band adjustable in length relative to its confronting engagement about the outer surface of said housing.

13. An assembly as in claim 1 wherein a locknut is secured to said housing and is internally threaded to engage an externally threaded surface on said sealing assembly.

14. An assembly as in claim 1 wherein said liquid exhaust is connected in liquid communication with a collection chamber disposed in spaced relation to said housing, pump means disposed in communicating relation with the interior of said collection chamber and structured to pump excess liquid therefrom upon the liquid reaching a certain predetermined quantity.

* * * * *